US006053625A

United States Patent [19]

Bowker

[11] Patent Number: 6,053,625

[45] Date of Patent: Apr. 25, 2000

[54] LIGHTING ASSEMBLY WITH PLURALITY OF TRAPEZOIDAL REFLECTOR FACES AND TRIANGULAR LENS FACES FOR CEILING MOUNTING IN STORAGE AREAS

[76] Inventor: James W. Bowker, 9085 Mission Blvd., Suite A1, Riverside, Calif. 92509

[21] Appl. No.: 08/970,967

[22] Filed: Nov. 14, 1997

[51] Int. Cl.[7] ..... F21V 7/00

[52] U.S. Cl. ..... 362/348; 362/310; 362/311; 362/328; 362/343; 362/346; 362/147; 362/339; 362/92

[58] Field of Search ..... 362/310, 311, 362/328, 343, 346, 348, 147, 339, 92

[56] References Cited

U.S. PATENT DOCUMENTS

| | | | |
|---|---|---|---|
| 3,552,297 | 1/1971 | Williams | 99/468 |
| 3,600,569 | 8/1971 | Matteson | 362/311 |
| 4,462,068 | 7/1984 | Shadwick | 362/311 |
| 5,278,737 | 1/1994 | Luce et al. | 362/147 |

*Primary Examiner*—Sandra O'Shea
*Assistant Examiner*—Ronald E. DelGizzi
*Attorney, Agent, or Firm*—Sheldon & Mak; Denton L. Anderson

[57] ABSTRACT

A lighting fixture comprises a housing, an induction lamp inside the housing, a lens disposed to direct light away from the housing in a light pattern, and a light reflector inside the housing which reflects light in cooperation with the lens. The light pattern produced by the lighting fixture has a substantially uniform lateral illumination at a given radial distance from the center of the lens. The lighting fixture also provides a high level of directional illumination in the vertical direction when mounted to a ceiling. The lighting fixture can be surface or recess mounted. The lighting fixture can comprise a tee electrical conduit to allow through feed wiring from one fixture to another fixture. The lighting fixture is particularly suitable for use in conventional walk-in coolers and freezers used in supermarkets.

15 Claims, 4 Drawing Sheets

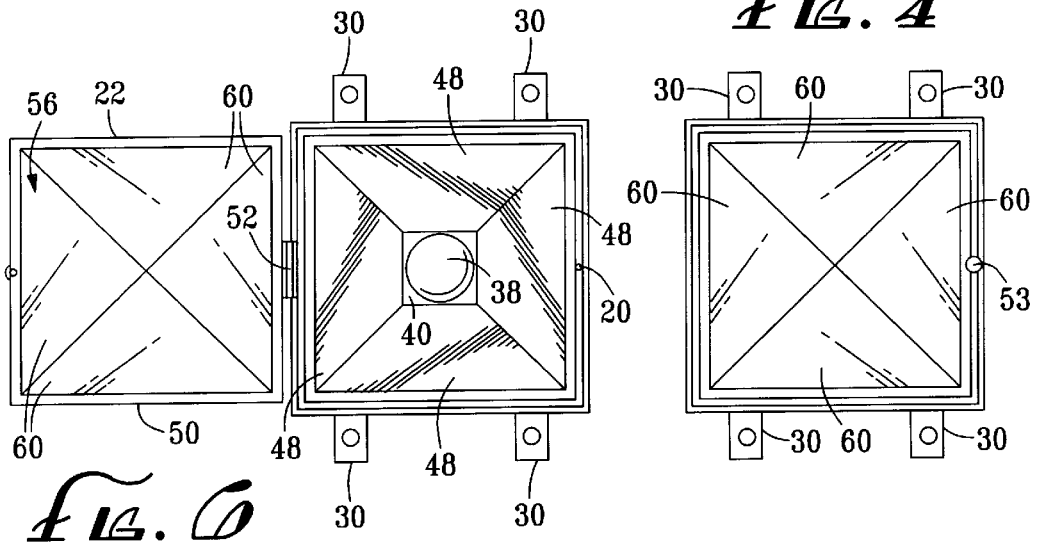
FIG. 4
FIG. 6
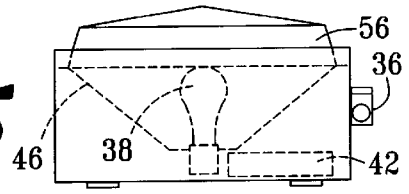
FIG. 5
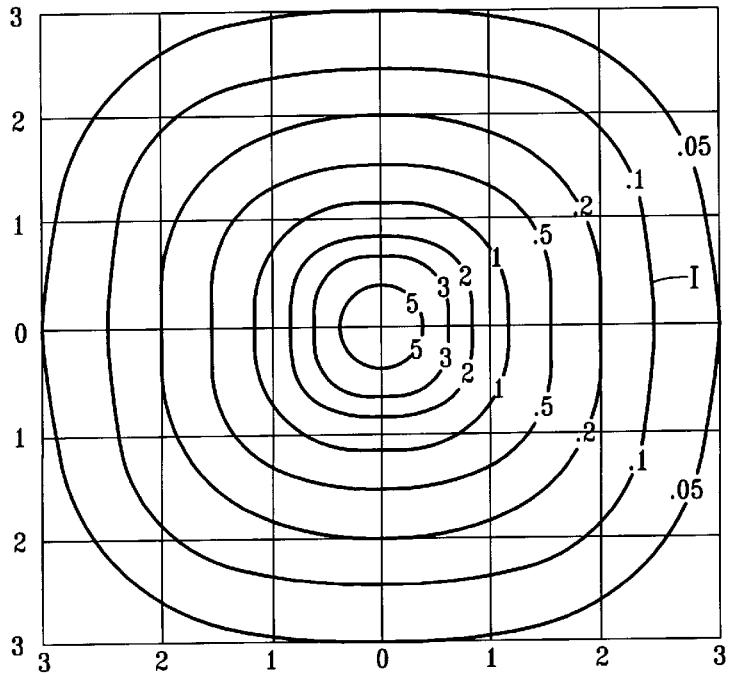
FIG. 7

LIGHTING ASSEMBLY WITH PLURALITY OF TRAPEZOIDAL REFLECTOR FACES AND TRIANGULAR LENS FACES FOR CEILING MOUNTING IN STORAGE AREAS

BACKGROUND

This invention is directed to a lighting fixture, particularly suitable for use in refrigerated storage units.

Supermarkets and other like establishments have walk-in refrigerated units to store fresh food products such as produce, meat and dairy products, and also to store frozen products such as ice cream and other frozen goods. Coolers typically operate at temperatures less than about 40° F., and freezers at less than about 0° F.

The refrigerated units have internal lighting to enable persons stocking or removing goods to see inside the unit. The low temperatures in refrigerated units and, particularly, in freezers, place special demands on lights and limit the types of lights that can be used inside them. Fluorescent lights generally do not reach full brightness ("restrike") at freezer temperatures and, accordingly, are unsuitable for this use. Other types of lights can restrike in freezers, but require a significant amount of time to do so. High-pressure sodium and metal halide lights require about twenty minutes to restrike. Consequently, these lights are typically continuously operated in freezers, resulting in high energy consumption and light replacement costs.

Incandescent lights are conventionally used in coolers and freezers. These lights have instant restrike, but have important disadvantages for freezer use. Incandescent lights generally do not have high energy efficiency, and thus are expensive to operate, and add to the cooling load on the refrigeration unit. Incandescent lights also have a relatively short service life. For example, conventional 100 watt incandescent lamps have a rated life of 1000 hours and must be replaced about nine times per year. Light replacement and associated labor costs can be significant, especially for larger supermarket chains. In addition, it is difficult to control the arc tube image in incandescent lights to produce a controlled light pattern so as to reduce dark spots in lighted areas. To increase the light coverage produced by incandescent lights, the number of lights can be increased. This approach, however, increases energy consumption and light replacement costs, and does not necessarily eliminate dark spots.

Accordingly, there is a need for a lighting fixture that can be used in refrigerated units such as coolers and freezers that (i) has instant restrike capabilities, (ii) has reduced energy consumption as compared to conventional lighting used in refrigerated units, and (iii) provides a controlled, uniform light pattern.

SUMMARY

The present invention satisfies the above needs. In particular, a lighting fixture according to the present invention is particularly suitable for use in refrigerated units and provides instant restrike capabilities, reduced energy consumption and replacement costs, and a spatially uniform light pattern.

The lighting fixture comprises a housing which can be mounted to a surface such as a ceiling in a refrigerated unit. A fixture to mount a light is disposed inside the housing. The light is typically an 85 watt induction lamp having high energy efficiency, long service life and a controllable arc tube image. A lens is disposed to direct light away from the housing in a controlled light pattern. The lens is typically mounted in a pivotable cover. A light reflector inside the housing reflects the light emitted by the induction lamp. The light assembly includes a mount, typically attached to the housing, for attaching the housing to a ceiling so that the reflector reflects light downwardly.

The reflector cooperates with the lens to generate a laterally uniform, downwardly directed light pattern. Specifically, the light pattern is sufficiently uniform that in substantially all planes parallel to the ceiling when the lighting assembly is mounted on the ceiling, the ratio of the minimum illumination to the maximum illumination, $r_d$, of the light pattern at the same radial distance from the center of the lens is at least about 0.95. Expressed in another way, in substantially all planes parallel to the ceiling, if a circle is drawn whose center is directly below the center of the lighting fixture, all locations on that circle have the same amount of illumination, within 5%.

The lighting fixture also provides a high level of downwardly directed illumination. Particularly, the light pattern can have an illumination ratio, $r_d$, of at least about 2:1 and preferably at least about 3:1. The illumination ratio is defined herein as the (i) light intensity at a first point directly below the lighting fixture at a selected distance, x, typically a mounting height, from a fixed point on the lighting fixture such as the center of the lens, to (ii) the light intensity measured at a second point located at the distance x laterally from the fixed point. In other words, at least twice as much light, and preferably three times as much light is directed downwardly by the lens/reflector combination as compared to the amount of light directed laterally. Typically, the mounting height of the lighting fixture is about 15 ft. above the floor in conventional coolers and freezers.

The mount can be mounting tabs on the housing to enable surface mounting of the lighting fixture to a support surface such as a ceiling. To provide recessed mounting capabilities, the housing can comprise a mounting rim extending peripherally about the housing.

The lighting fixture can include a tee electrical conduit attached to an outer surface of the housing to allow through feed wiring from one lighting fixture to another without having to open the covers of the lighting fixtures.

In a preferred reflector/lens configuration, the reflector is concave shaped outwardly towards the open end of the housing and comprises a plurality of trapezoidal reflector faces oriented in a first angle of from about 40 to about 50 degrees relative to the horizontal. The lens likewise is concave shaped, but in this case is so shaped inwardly toward the reflector. The lens comprises a plurality of triangular lens faces forming a baseless pyramid. The lens faces are retro-oriented at a second angle less than the first angle relative to the horizontal, and each lens face cooperates with a corresponding reflective face. Preferably each trapezoidal reflective face has a bilaterally symmetrical trapezoid shape. Preferably, the number of reflector faces and the number of lens faces are equal.

A plurality of lighting fixtures can be used in coolers and freezers conventionally used in retail stores to provide spatially uniform illumination. Conventional cooler and freezer units typically have a ceiling height of about 15 feet. At least two lighting fixtures including 85 watt induction lamps can be mounted to the ceiling to provide spatially uniform illumination and an illumination of at least about 5 footcandles substantially throughout the unit when the unit is empty.

DRAWINGS

These and other features, aspects and advantages of the present invention will become better understood from the following description, appended claims and accompanying drawings, where:

FIG. 4 is a bottom plan view of the lighting fixture of FIG. 2 with the cover in the closed position;

FIG. 5 is a side elevational view of the lighting fixture of FIG. 2 showing several elements in broken line;

FIG. 6 is a bottom plan view of the lighting fixture of FIG. 2 with the cover in the open position;

FIG. 7 is a plot of illumination versus distance (in mounting heights) from a center of the lighting fixture showing isolux lines at different radial distances from the center;

DESCRIPTION

The present invention provides a lighting fixture that overcomes disadvantages associated with known lighting fixtures used in refrigerated units including coolers and freezers.

Figure 1:
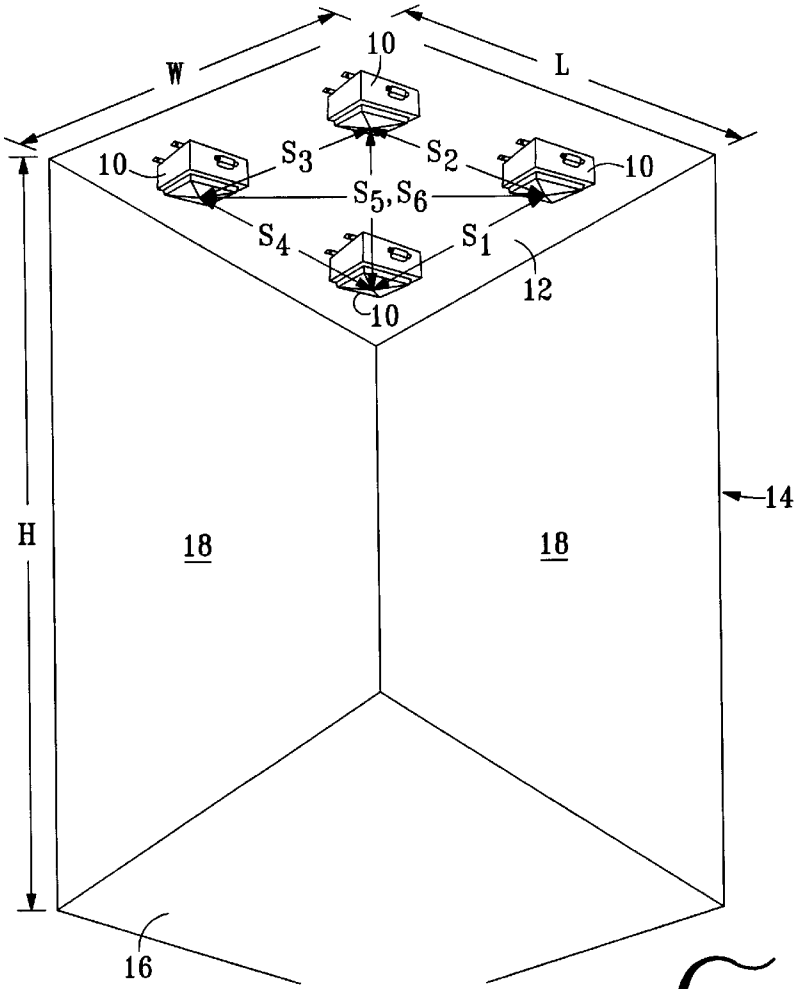
FIG. 1 is a perspective view showing a plurality of lighting fixtures according to the present invention attached to a ceiling inside a storage unit.
Figure 8:
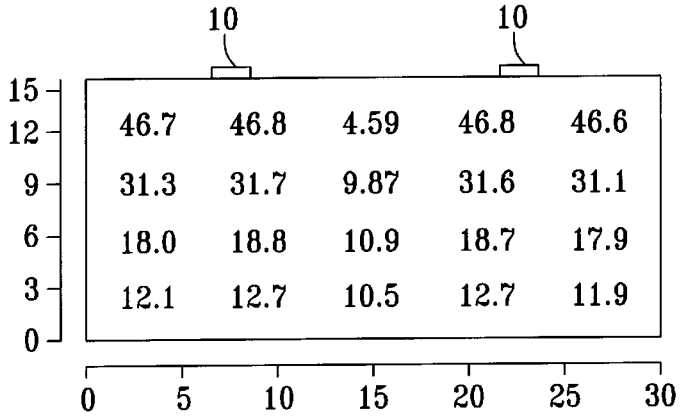
FIG. 8 shows the illumination at a number of points in a vertical plane directly below two lighting fixtures mounted to the ceiling in a meat cooler.
Figure 9:
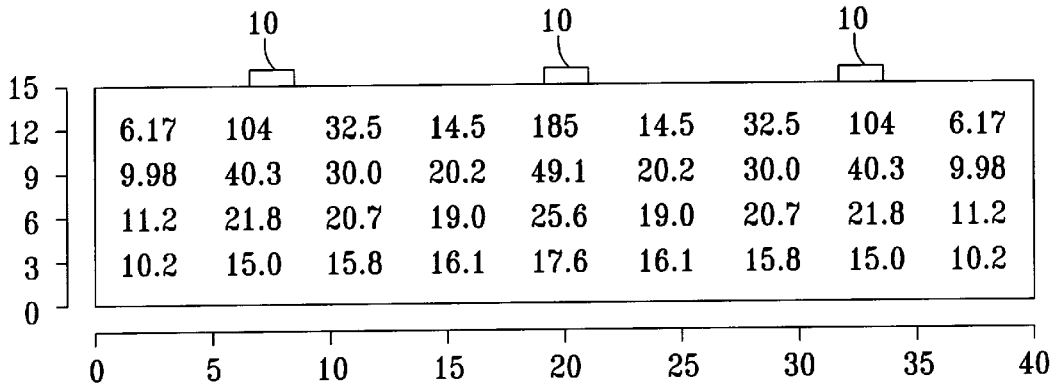
FIG. 9 shows the illumination at a number of points in a vertical plane directly below three lighting fixtures mounted to the ceiling in a produce cooler.
Figure 10:
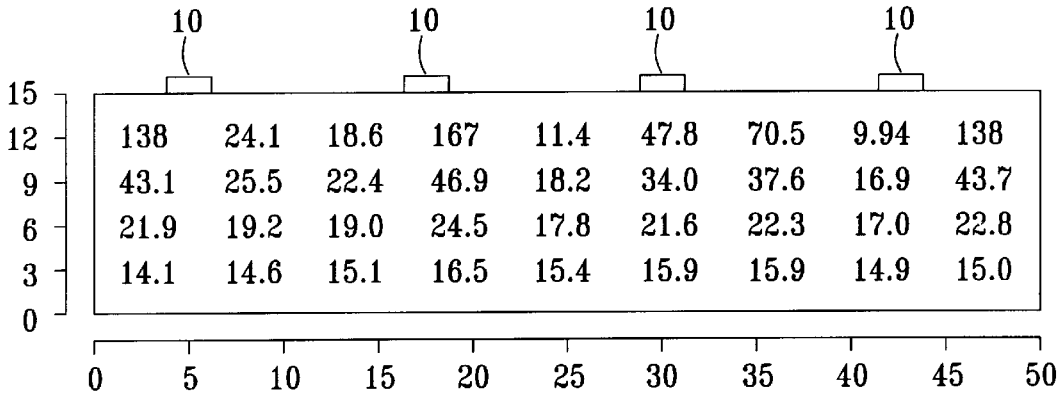
FIG. 10 shows the illumination at a number of points in a vertical plane directly below four lighting fixtures mounted to the ceiling in a general freezer.
Figure 11:
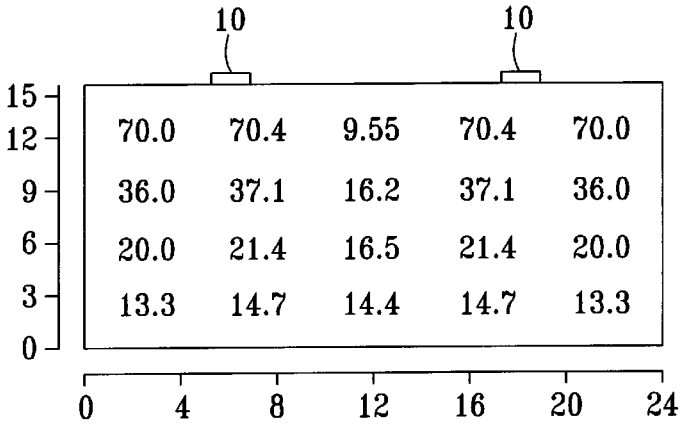
FIG. 11 shows the illumination at a number of points in a vertical plane directly below two lighting fixtures mounted to the ceiling in an ice cream freezer.

With reference to FIG. 1, a plurality of lighting fixtures 10 according to the present invention are shown mounted or attached to a ceiling 12 in a storage unit 14. The storage unit 14 includes a floor 16 and side walls 18. The storage unit 14 can be a refrigerated cooler or freezer such as conventionally used in retail stores to store fresh and frozen goods, respectively. The storage unit 14 can be non-refrigerated and used to store goods other than food.

The lighting fixture 10 comprises a housing 20 and a cover 22 attached to the housing. The cover is shown in a closed position in FIG. 2 and in an open position in FIG. 6. The housing 20 is typically square or rectangular shaped in horizontal section and comprises opposed side walls 24, a base or bottom wall 26 for mounting against the ceiling 12, and an open end 28 opposite the base 26. The side walls 24 typically have a height H of about 6 in., giving the lighting fixture 10 a low vertical profile construction.

A plurality of mounts, preferably mounting tabs 30, are provided on the housing 20 to mount the lighting fixture 10 to a support surface. The mounting tabs 30 include holes 32 for receiving fasteners such as screws 33. The housing 20 can alternately include a peripheral mounting rim 34 as shown in phantom line to recess mount the lighting fixture 10 to a surface. As is conventionally known in the industry, other mounts can be used, such as holes for fasteners in the base.

A conduit 36 can be mounted to a side wall 24 of the housing 20. The conduit 36 is preferably a tee-conduit as shown, to enable through feed wiring from one lighting fixture 10 to another in a multi-lighting fixture arrangement such as shown in FIG. 1, without opening the cover 22 of the lighting fixture 10 and potentially introducing contamination inside the housing 20.

Figure 3:
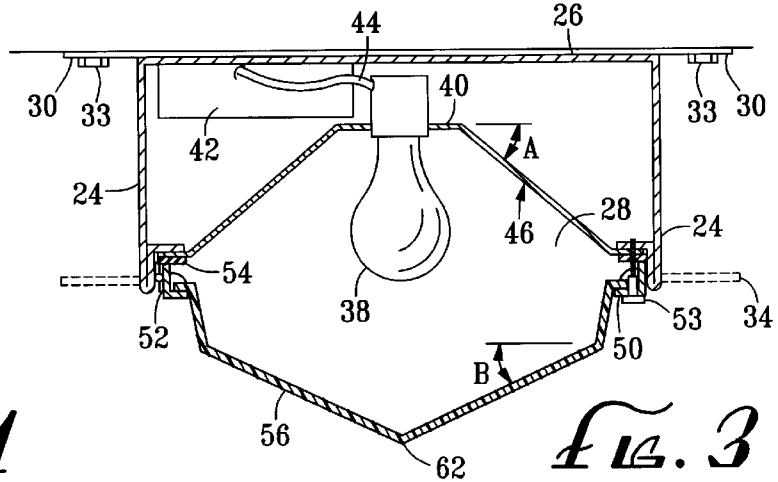
FIG. 3 is a sectional view of the lighting fixture in the direction of line 3—3 of FIG. 2.

A light 38 is mounted to a fixture such as a base 40 inside the housing 20. The light 38 is preferably an induction lamp. As shown in FIG. 3, the light 38 comprises a high-frequency generator 42 disposed behind the base 40 and electrically connected to the light 38 via wiring 44. Induction lamps have instant restrike capabilities at low temperatures used in freezers. Consequently, the induction lamp does not need to be continuously powered and can be selectively turned on and off, resulting in reduced energy consumption. In addition, induction lamps are energy efficient and have a long rated life. For example, induction lamps can have a rated life of about 100,000 hours (about 11 years). Furthermore, the arc tube image of induction lamps can be controlled to produce a controlled light pattern from the lighting fixture 10.

The light 38 is typically an 85 watt induction lamp. Other induction lamp power outputs such as 55 watt can also be used in the lighting fixture 10.

The lighting fixture 10 comprises a reflector 46 inside the housing 20. The reflector 46 is concave outwardly toward the open end 28 of the housing 20. The reflector 46 includes a plurality of light reflective faces 48 (FIG. 6). Typically, the reflector 46 comprises four reflector faces 48 as shown. The reflector faces 48 are formed of a highly light reflective material that preferably reflects substantially all light incident upon it from the light 38. A suitable reflective material for use in the lighting fixture 10 is anodically coated aluminum lighting sheet material having a controlled total reflectivity (including specular and diffuse reflectivity) of at least about 95%. Other light reflective materials such as laminated silver that provide about this controlled total reflectivity can also be used.

The reflector faces 48 typically have a trapezoidal shape such as the illustrated bilateral symmetrical trapezoidal shape. The reflector faces 48 are oriented at an angle A relative to the horizontal. The angle A is typically from about 40° to about 50°, and preferably about 45°. The oriented, highly light reflective reflector faces 48 cooperate with the light transmissive cover 22 to produce a light pattern characterized as having high spatial uniformity and a high level of downward illumination.

The cover 22 comprises a frame 50 pivotally connected to the housing 20 by one or more hinges 52. A fastener 53 maintains the cover closed. A sealing means 54 such as a resilient gasket is preferably provided on the housing 20 about the reflector 46 to form a dust-proof seal when the cover 22 is closed to prevent contamination entering inside the housing 20.

A lens 56 is mounted to the frame 50 of the cover 22. A sealing means 58 is preferably also provided between the lens 56 and the frame 50. The lens 56 is comprised of a light transparent material such as glass or plastic. The lens 56 preferably has high impact strength to resist cracking so as to reduce the possibility of contamination entering inside the housing 20. A suitable material for forming the lens that provides such high impact strength is polycarbonate. A preferred lens is available from KSH Plastics, Inc. of St. Louis, Mo., as Product No. PR400P.

Figure 2:
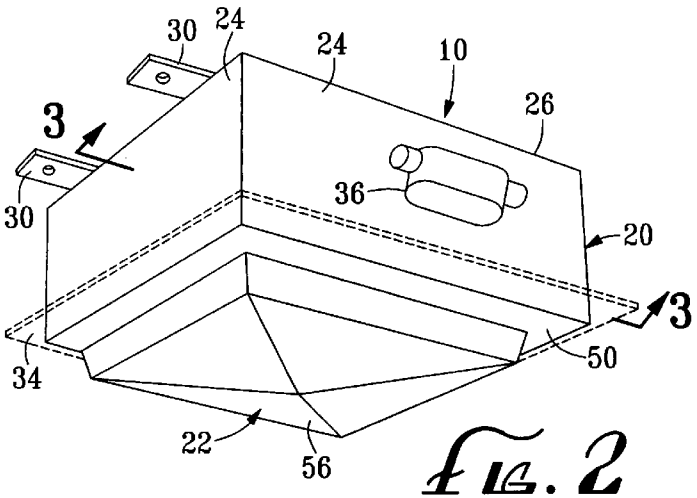
FIG. 2 is a perspective view of one of the lighting fixtures shown in FIG. 1.

The lens 56 is concave inwardly toward the closed base 26 of the housing 20 as shown in FIG. 3. In other words, the generally concave shaped surfaces of the lens 50 and the reflector 46 face each other. The lens 56 comprises a plurality of lens faces 60. The lighting fixture 10 preferably comprises the same number of lens faces 60 and reflector faces 48, typically four, such that each lens face 60 cooperates with a reflector face 48 in the closed position of the cover 22 shown in FIG. 4. The lens faces 60 are typically flat and triangular shaped as shown in FIG. 2, such that the lens faces 60 form a baseless pyramid.

The lens faces 60 are each oriented at an angle B (FIG. 3) relative to the horizontal. The angle B is typically less than the angle A of the reflector faces 48. In a typical lighting fixture 10, an angle B can be between about 10 and about 15 degrees. The angle A of the reflector faces 48 is selected to provide optimal light pattern spatial uniformity and illumination in cooperation with the lens 56.

The lens 56 transmits light that is reflected by the reflector 46, as well as unreflected light. The reflector 46 can reflect at least about 70% of the light emitted by the light 38 through the lens 56. Preferably, the reflector efficiency is at least about 75%. The remaining emitted light passes through the lens 56 generally transverse to the lighting fixture 10.

The lighting fixture 10 produces a light pattern having substantially uniform horizontal illumination at a given radial distance from a center of the lens. FIG. 7 illustrates the relative illumination pattern in a horizontal plane spaced below a lighting fixture 10 including an 85 watt induction lamp. For example, the plane can be the surface of the floor 16 of the storage unit 14 shown in FIG. 2, with the ceiling 12 and the floor 16 being spaced by about 15 ft. (one mounting height). The point C at 0,0 represents a point on the plane that is directly below the center 62 of the lens 56 (FIG. 3). The illumination 360° around each of the closed lines I (isolux lines) is substantially constant. Preferably, the ratio, $r_l$, of the minimum illumination, $I_{min}$, to the maximum illumination, $I_{max}$, in all horizontal planes, at any selected distance from the light, is at least about 0.95. Thus the lateral deviation from uniformity is no more than 5%. As shown, the relative illumination decreases from about 5 at a radial distance from the center C of about 0.5 mounting heights, to an illumination of about 0.05 moving radially outward from the point C to a distance of three mounting heights (45 ft.). The uniform radial light pattern produced by the lighting fixture 10 eliminates inadequately lighted areas ("dark spots") in the illuminated space.

The TABLE below gives the preferred number of lighting fixtures 10, each including an 85 watt induction lamp, and the preferred spacing, S, of the lighting fixtures as measured between the center of lenses of the lighting fixtures, for a conventionally sized meat cooler, produce cooler, general freezer and ice cream freezer, each having a 15 ft. ceiling height. The arrangement of the lighting fixtures in the ice cream freezer, for example, can be visualized by referring to FIG. 1, showing four lighting fixtures 10 mounted to the ceiling 12 at horizontal spacings, $S_1$, $S_2$, $S_3$, $S_4$, $S_5$ and $S_6$, relative to each other. As shown in the TABLE, the preferred number of lighting fixtures is 2, 3 or 4, and the preferred fixture spacing is 12 ft. or 15 ft. for the given storage unit dimensions.

The number of lighting fixtures and the on-center fixture spacing given in the TABLE achieves a high level of illumination at any location in the unit. To demonstrate the lighting capabilities of the lighting fixtures, the illumination was measured in each of the four refrigerated units at a horizontal plane about 3 ft. above the floor and having a length, L, and a width, W, of the same dimensions as those of the storage unit. The TABLE gives the minimum, maximum and average illumination (in footcandles), as well as the ratio of the minimum/maximum and minimum/average illumination in the horizontal plane. As shown, the measured minimum illumination in the units was 5.4 footcandles in the meat cooler. This illumination level avoids dark spots and provide users good visibility throughout the unit. In addition, the illumination uniformity was high as represented by the ratios.

Other numbers of lighting fixtures 10 and fixture spacings can be used in storage units having dimensions different than shown in the TABLE. For example, a storage unit 10 smaller than the produce cooler may only need one lighting fixture 10 to provide satisfactory illumination, while a storage unit larger than the ice cream freezer may need more than four lighting fixtures. The lighting fixture spacing typically is at least about 9 ft. The spacing between the lighting fixtures can be different in a given storage unit. For induction lamps having a lower wattage such as 55 watts, the number of lighting fixtures can be increased and the fixture spacing decreased to provide satisfactory illumination.

TABLE

| | | | | Horizontal Illumination | | | | |
|---|---|---|---|---|---|---|---|---|
| Refrigerated Unit | Dimensions [ft] | No. Lighting Fixtures | Lighting Fixture Spacing | Minimum Illumination[1] [Footcandles] | Maximum Illumination[1] [Footcandles] | Average Illumination[1] [Footcandles] | Minimum/ Maximum Illumination | Minimum/ Average Illumination |
| Meat Cooler | 31 × 24 × 15 | 2 | 15 | 5.4 | 12.7 | 8.9 | 0.43 | 0.61 |
| Produce Cooler | 39 × 16 × 15 | 3 | 12 | 8.3 | 17.6 | 12.9 | 0.47 | 0.64 |
| General Freezer | 47 × 16 × 15 | 4 | 12 | 6 | 16.7 | 12.3 | 0.36 | 0.49 |
| Ice Cream Freezer | 24 × 13 × 15 | 2 | 12 | 10.9 | 14.7 | 12.7 | 0.74 | 0.86 |

[1]In a horizontal plane 3 ft. above floor of unit.

In addition to providing uniform horizontal radial illumination, the lighting fixture 10 also provides a high level of illumination in a direction transverse to the lens 56, typically in a downward direction below the lighting fixture 10 when mounted to a horizontal surface such as a ceiling. A single lighting fixture 10, including an 85 watt induction lamp and located about 15 ft. above a surface, can produce the following illumination values: 46 footcandles at 3 ft. below the lighting fixture; 31 footcandles at 6 ft. below the lighting fixture; 18 footcandles at 9 ft. below the lighting fixture; and 12 footcandles at 12 ft. below the lighting fixture.

The directional illumination of the lighting fixture 10 can be represented by the "illumination ratio", $r_d$. The illumination ratio is defined herein as the (i) light intensity measured directly below the assembly to (ii) light intensity measured laterally from the assembly at the same selected distance is at least 2. The illumination ratio for a single lighting fixture is typically at least 2, and generally at least 3.

FIGS. 8–11 are plots of the illumination versus position in a vertical plane directly below the lighting fixtures 10 mounted to the ceiling in a meat cooler, produce cooler, general freezer and ice cream freezer, respectively, having dimensions as given in the TABLE. The plots show that the illumination at a given vertical distance below the lighting fixtures is generally greater than the illumination at a given horizontal distance from the lighting fixtures, for each of the different refrigerated units.

Although the present invention has been described in considerable detail with reference to certain preferred versions thereof, other versions are possible. Therefore, the scope of the appended claims should not be limited to the description of the preferred versions contained herein.

What is claimed is:

1. A lighting assembly comprising:

a) a housing having an open end;

b) a fixture for placement of a light at least partially inside the housing;

c) a lens at the open end to direct light away from the housing in a light pattern;

d) a reflector inside the housing to reflect light emitted by the light; and e) a mount for attaching the housing to a ceiling so that the reflector reflects light downwardly;

wherein i) the reflector is concave shaped outwardly toward the open end of the housing, the reflector comprises a plurality of trapezoidal reflector faces each being oriented at a first angle relative to the horizontal; and ii) the lens is concave shaped inwardly toward the reflector, the lens comprises a plurality of triangular lens faces forming a baseless pyramid, the lens faces each being oriented at a second angle less than the first angle relative to the horizontal, and each lens face cooperating with a reflector face; and wherein the lens and the reflector cooperate to focus emitted light downwardly so that when the light is in the light fixture and turned on, and the assembly is ceiling mounted, the illumination ratio, $r_d$, of (i) light intensity measured directly below the assembly at a selected distance to (ii) light intensity measured laterally from the assembly at the same selected distance is at least 2.

2. The lighting assembly of claim 1, wherein $r_d$ is at least 3.

3. The lighting assembly of claim 1 wherein the light pattern has a substantially uniform lateral illumination.

4. The lighting assembly of claim 3 wherein in substantially all planes parallel to the ceiling, when the assembly is attached to the ceiling, the ratio of minimum illumination to the maximum illumination of the light pattern at the same lateral distance from the center of the lens, is at least about 0.95.

5. The lighting assembly of claim 1 wherein the lighting assembly has a reflector efficiency of at least about 75%.

6. The lighting assembly of claim 1 wherein the mount comprises mounting tabs attached to the housing.

7. The lighting assembly of claim 1, further comprising a tee electrical conduit attached to an outer surface of the housing.

8. The lighting assembly of claim 1 wherein the housing has a depth of about 6 inches.

9. The lighting assembly of claim 1, wherein there are four trapezoidal reflector faces and four triangular lens faces.

10. The lighting assembly of claim 1, wherein the first angle is from about 40° to about 50° relative to horizontal.

11. The lighting assembly of claim 1 further comprising an 85 watt induction lamp at least partially inside the housing.

12. A lighting assembly comprising:

a) a housing having an open end;

b) a fixture for placement of a light at least partially inside the housing;

c) a lens at the open end to direct light away from the housing in a light pattern;

d) a reflector inside the housing to reflect light emitted by the light; and e) a mount for attaching the housing to a ceiling so that the reflector reflects light downwardly;

wherein the lens and the reflector cooperate to focus emitted light downwardly so that when the light is in the light fixture and turned on, and the assembly is ceiling mounted, the illumination ratio, $r_d$, of (i) light intensity measured directly below the assembly to (ii) light intensity measured laterally from the assembly at the same selected distance is at least 2;

wherein in substantially all planes parallel to the ceiling, when the assembly is attached to the ceiling, the ratio of minimum illumination to the maximum illumination of the light pattern at the same lateral distance from the center of the lens, is at least about 0.95; and wherein i) the reflector is concave shaped outwardly toward the open end of the housing, the reflector comprises a plurality of trapezoidal reflector faces each being oriented at a first angle of from about 40° to about 50° relative to the horizontal; and ii) the lens is concave shaped inwardly toward the open end of the housing, the lens comprises a plurality of triangular lens faces forming a baseless pyramid, the lens faces each being oriented at a second angle less than the first angle relative to the horizontal, and each lens face cooperating with a reflector face.

13. A lighted storage unit, comprising:

a) a storage unit, including i) opposed side walls;

ii) a top ceiling; and iii) a floor opposite the ceiling, wherein the side walls, ceiling and the floor define a space; and b) a plurality of lighting assemblies mounted to the top wall, each lighting assembly comprising:

i) a housing having an open end;

ii) an 85 watt induction lamp at least partially inside the housing;

iii) a lens disposed at the open end to direct light away from the housing; and iv) a reflector inside the housing and cooperating with the lens to reflect light emitted by the lamp;

wherein (i) the lighting assemblies are spaced apart from each other by at least about 9 feet, (ii) the lighting fixtures produce a light pattern having an illumination level of at least about 5 footcandles at substantially all locations in the space, when the space is empty; (iii) each reflector is concave shaped outwardly toward the open end of the housing, the reflector comprises a plurality of trapezoidal reflector faces each being oriented at a first angle of from 40° to about 50° relative to the horizontal; (iv) each lens is concave shaped inwardly toward the reflector, the lens comprises a plurality of triangular lens faces forming a baseless pyramid, the lens faces each being oriented at a second angle less than the first angle relative to the horizontal, and each lens face cooperating with a reflector face; and (v) the lens and the reflector cooperate to focus emitted light downwardly so that when the light is in the light fixture and turned on, and the assembly is ceiling mounted, the illumination ratio, $r_d$, of light intensity measured directly below the assembly to light intensity measured laterally from the assembly at the same selected distance is at least 2.

14. The lighted storage unit of claim 13, wherein the storage unit is a refrigerated storage unit and the top wall is spaced about 15 feet from the bottom wall.

15. The lighted storage unit of claim 13, wherein the number of lighting fixtures is between two and four.

* * * * *